United States Patent [19]

Rosynek

[11] 4,143,788

[45] Mar. 13, 1979

[54] CHILD RESISTANT SAFETY CLOSURE

[75] Inventor: John J. Rosynek, Dolton, Ill.

[73] Assignee: The Continental Group, Inc., New York, N.Y.

[21] Appl. No.: 824,473

[22] Filed: Aug. 15, 1977

[51] Int. Cl.[2] ..... B65D 41/32

[52] U.S. Cl. ..... 220/273

[58] Field of Search ..... 220/269–273

[56] References Cited

U.S. PATENT DOCUMENTS

| | | | |
|---|---|---|---|
| 3,838,788 | 10/1974 | Stargell | 220/273 X |
| 3,958,718 | 5/1976 | Kowalik et al. | 220/273 |
| 4,014,455 | 3/1977 | LaCroce | 220/271 X |

*Primary Examiner*—George T. Hall

*Attorney, Agent, or Firm*—John J. Kowalik; Joseph E. Kerwin; William A. Dittmann

[57] ABSTRACT

An improved child resistant end closure wherein the pull tab for an easy opening end is mounted within a panel bead; the tab being fastened by the rivet to a tear-out portion of the end panel. The tear-out portion is adapted to be pulled outwardly about a hinge line which intersects the bead. The bead is reduced in depth at the intersection with the hinge line and formed to permit the bead to fold in such manner as to resist sudden flip-out of the tear-out portion which in the previous designs has caused splashing out of the contents in the container.

10 Claims, 10 Drawing Figures

FIG. 1
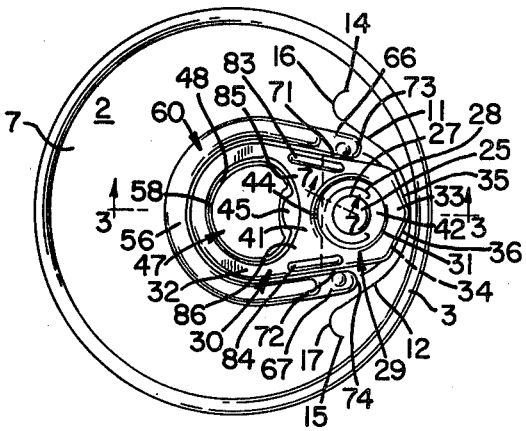
FIG. 2
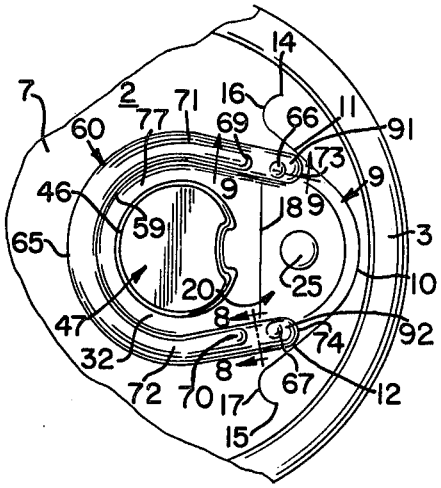
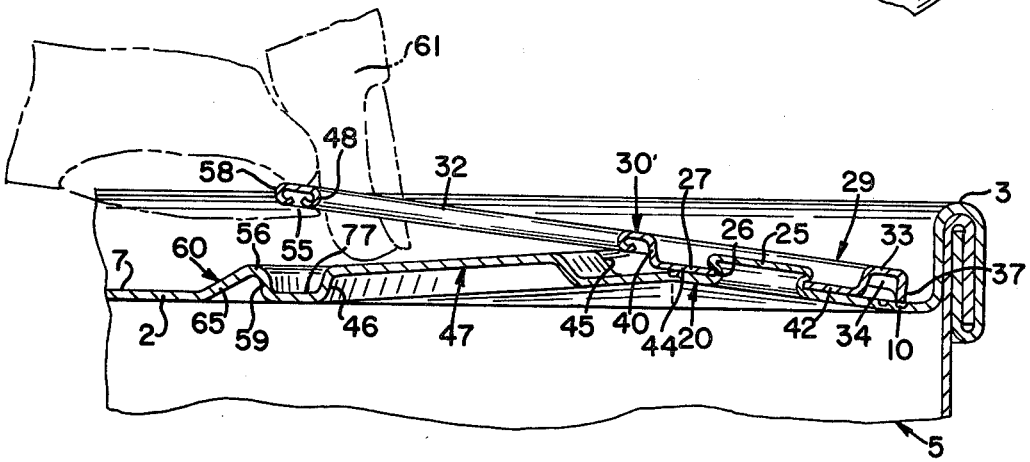
FIG. 3
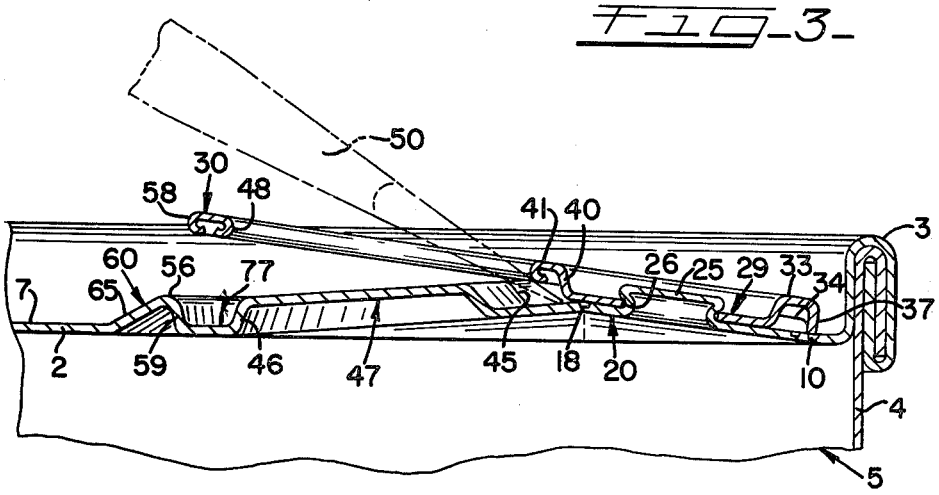
FIG. 4

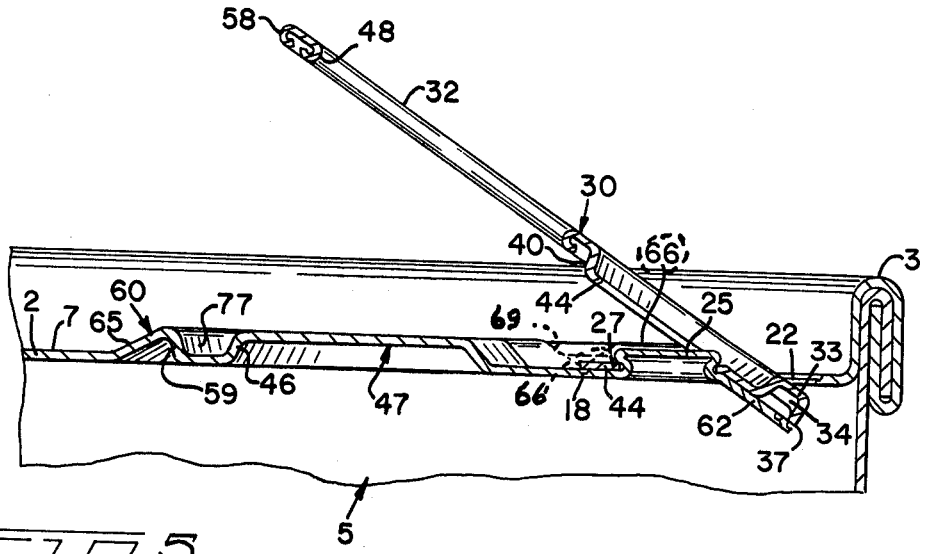
FIG. 5
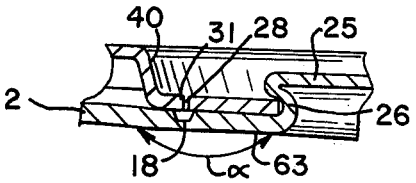
FIG. 10
FIG. 6
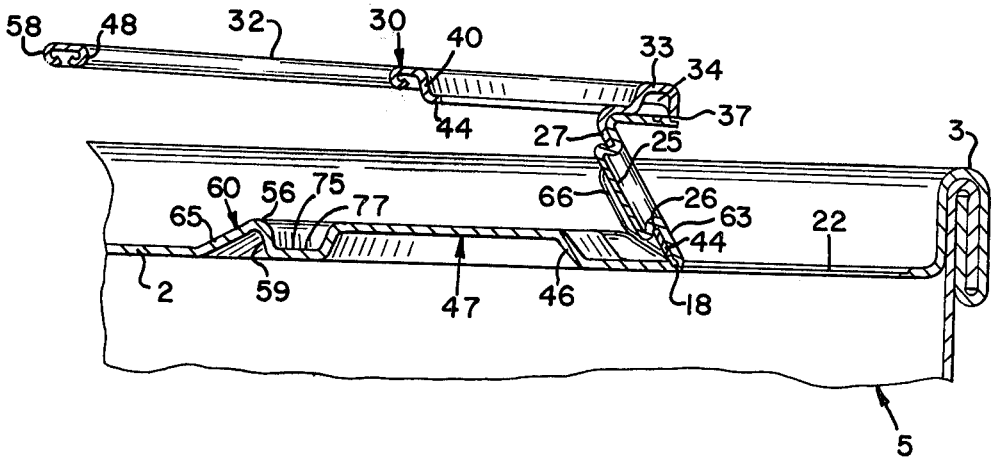

CHILD RESISTANT SAFETY CLOSURE

DISCUSSION OF THE INVENTION

The best art known are three U.S. Pat. Nos. 3,986,631, 3,967,754 and 3,958,718 owned by the assignee of the present invention. Each of these patents disclose different inventive features which, in their own way, provide a child resistant closure. In this art, however, even though the prior closures may legally qualify as being safe, it is the objective of this invention to improve the structure to make it more perfect to preclude even unanticipated accidents which would be legally excusable. Thus, the various features disclosed in the foregoing patents are improved for greater safety and functionality. This invention is an improvement over my invention disclosed in U.S. application Ser. No. 794,882 filed May 9, 1977 entitled Child Resistant Safety Closure.

SUMMARY OF THE INVENTION

A primary object is to provide in an easy opening container a closure in which the tab is shielded in a way as to prevent small fingers of a child from prying up the tab and opening the container and in which means are provided to prevent sudden jerk-like flip-out of the pull-out flap which forms the pour opening of the container.

The invention comprehends providing an easy opening closure in which a tab is used to break open a scored segment of the end panel; the tab being hinged to the end panel but being inhibited from rapidly hinging out and then abruptly stopping and thus shaking the container and causing the contents to splash out.

The invention provides a novel yieldably resistant hinge for the pull-out flap.

These and other objects and advantages inherent in and encompassed by the invention will become readily apparent from the following specification and drawings, wherein:

FIG. 1 is a top plan view of an end member incorporating the invention;

FIG. 2 is an enlarged top plan view of a portion of FIG. 1 with the tab removed;

FIG. 3 is an enlarged fragmentary cross-sectional view taken substantially on line 3—3 of FIG. 1 illustrating digital operation of the device;

FIG. 4 is similar to FIG. 3 showing opening the device with a tool;

FIG. 5 is a section similar to FIGS. 3 and 4 showing the tab raised to a position breaking the score and hinge attachment strap;

FIG. 6 is a sectional view similar to FIGS. 3-5 showing the device in fully open position;

FIG. 10 is an enlarged fragmentary sectional view taken longitudinally of the tab in the area of the rivet, and shows the specific details of the scores in the end panel and the tab.

DESCRIPTION OF THE INVENTION

Figure 7:
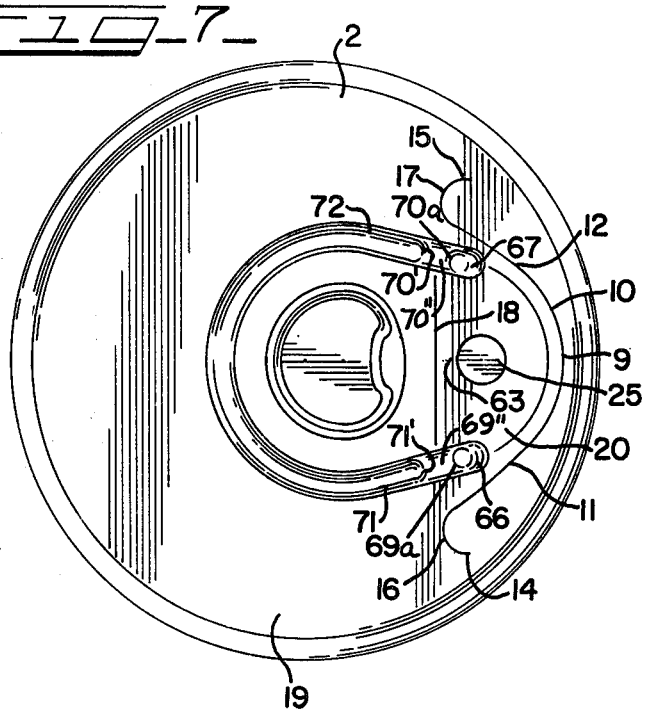
FIG. 7 is an enlarged bottom plan view of the novel end member.

The invention is shown in association with a metal end panel 2, preferably steel or aluminum, which is seamed about its periphery 3 to the body 4 of a can 5.

The end panel is formed on its external side 7 adjacent to its periphery with a U-shaped score line 9 which has its bight or arcuate portion 10 adjacent to the periphery of the end member 2 and a pair of laterally spaced legs 11,12 which diverge toward the center of the panel and terminate in outwardly curved end portions 14,15, the crests 16 and 17 of which are tangent to a hinge score 18 which is formed in the bottom side 19 of the panel and extends cross-wise of the legs 11 and 12 of the score and permits the tear open segment or section 20 defined by the score to hinge upwardly as seen in FIG. 6 to provide a pour opening 22 in the end panel.

The tear open section 20 is provided with an integral rivet 25 which extends through aperture 26 in a hinge lug 27 defined by a C-shaped cut 28 provided through a wall 31 of an intermediate securement section 29 of a sheet metal tab 30 also preferably formed of steel or aluminum.

The tab in addition to its intermediate portion has a lift or ring end portion 32 and a nose portion 33. The nose portion has a curl 34 about its periphery and has forward edges 35,36 which converge into an apex having a downwardly extending nib 37 which is aligned vertically over the bight portion of the score for pressing thereinto attendant to lifting of the tab. The intermediate portion also has a reinforcing curl along its side edges and the ring portion is formed C-shaped in cross-section as seen in FIG. 5.

The securement section 29 of the intermediate portion of the tab is of dished shape and has an annular frusto-conical wall section 40 which at its lower edge is integral with wall 31 and at its upper edge merges with the top wall 41 of the tab.

As best seen in FIGS. 1, 5 and 6, the hinge lug 27 is connected at its end remote from its hinge connection at 42 with the nose portion, by a fracturable strap 44 to the wall 40 adjacent to the ring or lift portion 35 of the tab and is positioned on the longitudinal center line of the tab as indicated by line 3—3 of FIG. 1 in alignment with the piercing nib 37 of the nose and directly forwardly of a notch or depression 45 formed in the frusto-conical side wall 46 of a button or internal shield 47 which extends into a finger hole 48 of the ring portion of the tab. The placement of this cavity 45 is strategic in that with the tab laying flat against the external side of the panel, the user is accommodated insertion of a tool 50 (FIG. 4) such as the end of a screw driver to lift the handle or lift end of the tab upwardly as seen in FIG. 4 so that the ring or lift portion is then accessible for grasping and lifting to open the container.

Alternatively, the invention embodies digitally operable means for lifting the tab as seen in FIG. 3. In such instance, the user inserts his thumb nail 55 over an arcuate apex or fulcrum crest 56 into a crack 57 between an external edge 58 of the ring and a closely confining upright wall 59 of an outer shield or rib generally designated 60. The user then using his nail as a lever cants it over the fulcrum 56 and then lifts the tab upwardly clearing the upper edge of the outer shield and works his forefinger 61 (FIG. 3) into the ring opening 48 and progresses with his finger under the ring portion whereupon the user may pull the ring upwardly to break the connecting strap 44, which is made to break at 6 to 8 pounds of pull beyond the normal capability of a child. Further lifting of the ring portion causes the tab to hinge about the hinge connection 42 of the hinge lug 27 and to bend the forward part 62 of the separable or openable panel segment inwardly as seen in FIG. 5. The user then pulls upwardly on the ring toward himself and continues to tear a rear part 63 of the tear portion or segment 20 until the tearing reaches the rear ends of the legs 11 and 12 of the score whereupon the rear portion of the tear section 20 hinges upwardly along hinge line 18 until it is cleared from the pour opening and assumes an upright position, and if pulled for enough, assumes a rearwardly upwardly inclined position shown in FIG. 6 disposed at an acute included angle to the remaining panel portion.

It will be observed that the curved ends 14 and 15 of the score 9 inhibit tearing of the end panel beyond the rear ends of the legs 11 and 12.

It will be observed that the rear portion 60 of the shield or bead is horse-shoe or U-shaped and that it is formed with an external wall 65 which slopes away from the crest 56 at an acute angle to the remaining end panel portion and merges therewith.

A feature of the invention is in providing bead extensions 66, 67 at the terminal forward ends 69, 70 of the legs 71, 72 of the rear portion of the external shield, bead or rib 60. The terminal ends 69, 70 are disposed rearwardly of the hinge axis 18 and slope thereto and the forward extensions 66, 67 are preferably formed on the rear portion 63 of the openable segment 20 along the lateral edges thereof between the legs 11, 12 of the score line 9 and the lateral edges 71, 72 of the intermediate portion of the tab in close confinement thereto to prevent the possibility of a child inserting anything beneath the tab and thus lifting it. The forward ends 73, 74 of these extension ribs terminate in transverse alignment with the rear portion of the attachment rivet 25.

Figure 8:
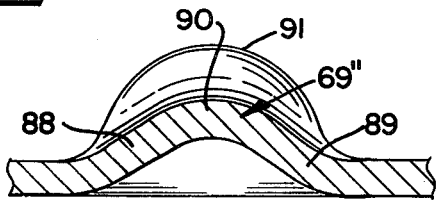
FIG. 8 is a sectional view taken substantially on line 8—8 of FIG. 2.
Figure 9:
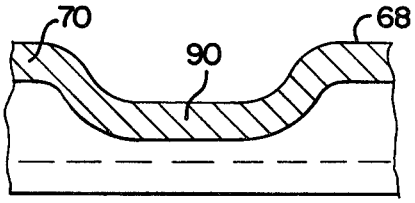
FIG. 9 is a cross-sectional view taken substantially on line 9—9 of FIG. 2.

A primary feature of this invention is in providing channel-shaped transition sections 69″, 70″ between the forward ends 69′, 70′ of legs 70, 71 of rib 60 and rear ends **69*a*, 70*a* of the extensions 66, 67. The sections 69″, 70″ are identical and are U-shaped in cross-section (FIG. 8) having side webs 88, 89 interconnected by a top bight portion 90. The bight portion 90 is disposed below the crests 91, 92 of the extensions 66, 67, which crest 91, 92 are at the same elevation as the apex crest 56 of the main shield 60**.

As the tab is lifted after the initial break, the sections 69′, 70′ resist folding, but upon sufficient pull load being applied through the tab will deform by spreading the webs 88, 89 and bending the bight portion 90. This resistance has been found to effectively reduce the end shock such as occurs when my previous container was opened as disclosed in U.S. patent application, Ser. No. 794,882, filed on May 9, 1977, entitled "Childproof Closure — Easy Open End".

Another important feature of the invention is in having the end panel bowed slightly downwardly at an angle $\alpha$ (shown exaggerated in FIG. 10) and designated between the rivet and the bottom wall portion 75 of the ring shield which with the inner and outer portions of the rear shield defines a groove 77 which admits the ring portion therein. This causes the lifting or ring portion to be biased into the groove 77 and yieldably maintained therein so that if a child should somehow manage to lift the ring upwardly to the positions shown in FIGS. 3 or 4, it will be difficult to hold because it will snap back into the groove. In addition, before the child could open the scored portion, he would have to exert 6–8 pounds of upward pull to break the strap. Thus, a novel and safe arrangement has been provided.

In addition, the top wall 80 of the button is substantially coplanar with the top side 81 of the ring portion so that it is virtually impossible to insert anything between the side wall of the button and inner edge of the ring.

A still further feature is in forming the protective or shield bead extensions on the rear portion 63 of the openable segment for rigidifying the rear portion and preventing it from buckling when being lifted so that it bends into a shape of the numeral seven when lifted as best seen in FIG. 6.

Raised rigidifying ribs 83,84 are also provided on the tab along its side edges in the triangular areas 85,86 in the transition connection between the intermediate section and the forward segment of the ring portion to prevent bending when the tab is lifted.

It will be readily understood from the foregoing description, that an effective child resistant closure device has been provided and that various modification will now become apparent which fall within the scope of the appended claims.

What is claimed is:

1. A pull-out closure for a can or similar container having an end panel with a tear score therein defining a tear flap adapted to be torn outwardly from said end panel and folded about a transverse hinge score in the end panel to form a pour opening, tab means connected to said flap for breaking the tear score and pulling the flap outwardly, and preprogramed bendable means for yieldably resisting folding of said flap about said hinge score.

2. The invention according to claim 1 and said means for resisting folding comprising beads formed in said end panel at opposite ends of said hinge score.

3. The invention according to claim 1 and said means for resisting folding comprising beads formed in said end panel at opposite ends of said hinge score and said beads extending transversely to said hinge score.

4. The invention according to claim 1 and said means for resisting folding comprising beads formed in said end panel at opposite ends of said hinge score and said beads being of arcuate cross-section.

5. The invention according to claim 1 and said means for resisting folding comprising beads formed in said end panel at opposite ends of said hinge score and said beads being of arcuate cross-section and said tear score being generally U-shaped and having a bight portion adjacent to the periphery of the end panel and having laterally spread legs terminating in curved end portions and said hinge score positioned between said legs substantially tangentially to said curved end portions.

6. A safety closure for a can or similar container having an end panel with a U-shaped tear score defining a flap and hinge means for the flap on the end panel disposed across the open of the U and forming a bend line, a tab for fracturing the score secured intermediate its ends to said flap and having one end at one side of said hinge means operative to fracture said tear score attendant to lifting of the other end of the tab thereby bending a portion of said flap inwardly of the container in an area ahead of the securement of the tab thereto and thereafter attendant to the tab being pulled outwardly of the container said tab causing said flap to hinge about said hinge means to a position uncovering a pour opening, and bendable panel-rigidifying means formed in said flap in the regions between the ends of said hinge means and adjacent ends of said tear score and extending across said bend line for controllably resisting by bending hinging of said flap about said hinge means.

7. A safety closure for a can or similar container having an end panel with chordally disposed hinge means, and having a U-shaped tear score defining a flap adapted to be torn outwardly from the end panel and hinging about said hinge means to form a pour opening in said end panel, a tab having opposite end portions one of which comprises a lift portion, an intermediate portion hingedly connected intermediate its ends to said flap, and shield means on said end panel having a portion encompassing said lift portion of said tab and having extensions flanking said intermediate portion of said tab, and tab-lift resisting means disposed between said extensions and said portion of said shield means.

8. The invention according to claim 6 and said resisting means comprising shallow convex ribs defined from radii extending transversely to the axis of said hinge means.

9. The invention according to claim 6 and said resisting means comprising indentations in said shield means.

10. The invention according to claim 8 and said ribs extending outwardly from the end panel a lesser distance than said shield means.

* * * * *